US009265357B2

(12) United States Patent
Fang

(10) Patent No.: US 9,265,357 B2
(45) Date of Patent: Feb. 23, 2016

(54) NURSING AND INFANT SUPPORT PILLOW

(71) Applicant: Munchkin, Inc., Van Nuys, CA (US)

(72) Inventor: Ruth Hsin-Ju Fang, Alhambra, CA (US)

(73) Assignee: MUNCHKIN, INC., Van Nuys, CA (US)

( * ) Notice: Subject to any disclaimer, the term of this patent is extended or adjusted under 35 U.S.C. 154(b) by 0 days.

(21) Appl. No.: 14/515,442

(22) Filed: Oct. 15, 2014

(65) Prior Publication Data

US 2015/0101125 A1 Apr. 16, 2015

Related U.S. Application Data

(60) Provisional application No. 62/000,422, filed on May 19, 2014, provisional application No. 61/891,340, filed on Oct. 15, 2013.

(51) Int. Cl.

| | |
|---|---|
| ***B68G 5/00*** | (2006.01) |
| ***A47C 16/00*** | (2006.01) |
| ***A47D 13/08*** | (2006.01) |
| *A47G 9/10* | (2006.01) |

(52) U.S. Cl.

CPC ..... *A47D 13/083* (2013.01); *A47D 13/08* (2013.01); *A47G 9/10* (2013.01); *A47G 2009/1018* (2013.01)

(58) Field of Classification Search

CPC ..... A47D 13/00; A47D 13/08; A47D 13/083; A47G 9/10; A47G 9/1009; A47G 2009/1018

See application file for complete search history.

(56) References Cited

U.S. PATENT DOCUMENTS

| | | | | |
|---|---|---|---|---|
| 4,679,263 | A * | 7/1987 | Honer | 5/640 |
| 4,733,836 | A * | 3/1988 | Barnes | 248/106 |
| 5,154,649 | A * | 10/1992 | Pender | 5/655 |
| 5,163,195 | A * | 11/1992 | Hill | 5/637 |
| 5,347,669 | A * | 9/1994 | Neviaser et al. | 5/655 |
| 5,664,828 | A * | 9/1997 | Simon | 297/153 |
| 6,006,381 | A * | 12/1999 | Tandrup | 5/655 |
| 6,484,337 | B1 * | 11/2002 | Moe et al. | 5/652 |
| 6,711,770 | B1 * | 3/2004 | Owens et al. | 5/655 |
| 6,842,925 | B1 * | 1/2005 | Owens et al. | 5/655 |
| 7,320,401 | B1 * | 1/2008 | Chandler | 206/315.2 |
| 7,562,406 | B1 * | 7/2009 | Leach | 5/655 |
| 7,975,336 | B1 * | 7/2011 | Perry et al. | 5/640 |
| 8,321,977 | B1 * | 12/2012 | Kummerfeld et al. | 5/636 |
| 8,418,294 | B1 * | 4/2013 | Davis | 5/640 |
| 2002/0023301 | A1 * | 2/2002 | Vuuren | 5/655 |
| 2002/0104166 | A1 * | 8/2002 | Mangiaracina | 5/655 |
| 2005/0235425 | A1 * | 10/2005 | Parrilla | 5/655 |
| 2005/0278853 | A1 * | 12/2005 | Littlehorn et al. | 5/636 |
| 2006/0075563 | A1 * | 4/2006 | Bartner et al. | 5/655 |
| 2006/0162080 | A1 * | 7/2006 | Littlehorn et al. | 5/652 |
| 2006/0179575 | A1 * | 8/2006 | Goodwin et al. | 5/655 |
| 2006/0260057 | A1 * | 11/2006 | Dunn et al. | 5/655 |
| 2006/0265809 | A1 * | 11/2006 | Wagner | 5/655 |

(Continued)

*Primary Examiner* — David E Sosnowski

(74) *Attorney, Agent, or Firm* — Robert Z. Evora, Esq.; Wade C. Yamazaki, Esq.

(57) ABSTRACT

A nursing and infant support pillow having a cushion fastened to a pillow top. The cushion has a midsection, a first end section and a second end section, and the pillow top having a midsection, a first foldable end and a second foldable end. The first and second foldable end pivot about a first and second hinge, respectfully, such that in a folded position, the foldable end is disposed between the cushion and the pillow top to form at least one three layer portion.

12 Claims, 15 Drawing Sheets

(56) References Cited

U.S. PATENT DOCUMENTS

| | | | | |
|---|---|---|---|---|
| 2007/0056110 | A1* | 3/2007 | Tuoriniemi et al. | 5/655 |
| 2007/0245494 | A1* | 10/2007 | Dockendorf | 5/655 |
| 2007/0271703 | A1* | 11/2007 | Matthews Brown et al. | 5/636 |
| 2008/0071205 | A1* | 3/2008 | Howard | 602/21 |
| 2008/0209639 | A1* | 9/2008 | Lord | 5/655 |
| 2009/0235459 | A1* | 9/2009 | Tidwell et al. | 5/640 |
| 2010/0175192 | A1* | 7/2010 | Aiken et al. | 5/632 |
| 2011/0119833 | A1* | 5/2011 | Clark | 5/655 |
| 2012/0073058 | A1* | 3/2012 | Sclare et al. | 5/652 |
| 2012/0131747 | A1* | 5/2012 | Sclare et al. | 5/421 |
| 2012/0222218 | A1* | 9/2012 | Davis et al. | 5/490 |
| 2013/0012883 | A1* | 1/2013 | Fitzgerald et al. | 604/179 |
| 2013/0145556 | A1* | 6/2013 | Kummerfeld et al. | 5/655 |
| 2013/0278431 | A1* | 10/2013 | Shilts et al. | 340/686.6 |
| 2014/0082847 | A1* | 3/2014 | Thomas | 5/655 |
| 2015/0013072 | A1* | 1/2015 | Clarke et al. | 5/640 |

* cited by examiner

NURSING AND INFANT SUPPORT PILLOW

CROSS REFERENCE TO RELATED APPLICATION

This application claims priority to U.S. Provisional Application Ser. No. 62/000,422 filed May 19, 2014 and U.S. Provisional Application Ser. No. 61/891,340 filed Oct. 15, 2013; the contents of all of which are hereby incorporated by reference herein in their entirety into this disclosure.

TECHNICAL FIELD

The subject disclosure relates generally to the field of pillows, and in particular to pillows that may be used to support various items. More specifically, the invention relates to pillows that may rest on a user's lap to help support a nursing infant.

BACKGROUND

Pillows have a wide variety of uses. For example, pillows are used almost universally when sleeping to support the head. However, pillows and/or other cushions may also be for a variety of other uses, such as to support an infant during breast feeding.

Unfortunately, conventional pillows and/or boosters have not been suitable for use with nursing infants.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 1:
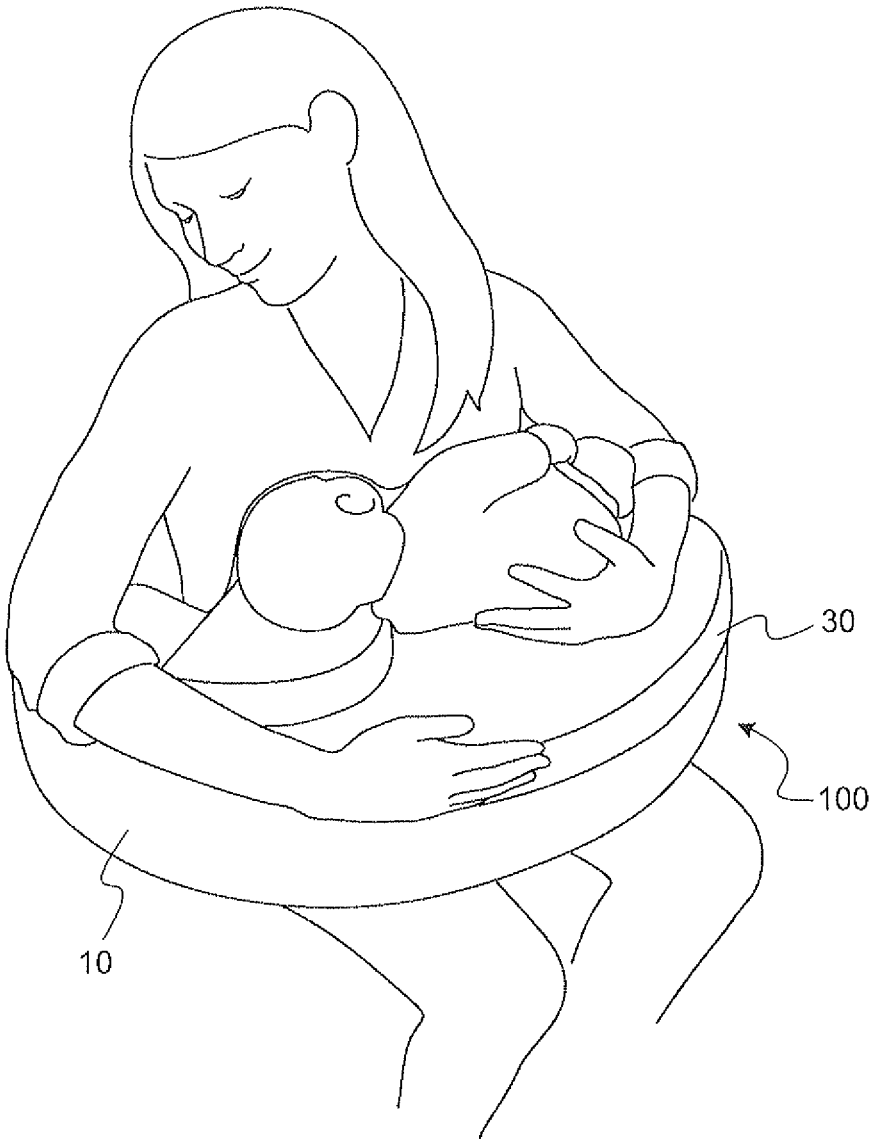
FIG. 1 illustrates an exemplary nursing pillow according to the subject disclosure.

FIG. 1 illustrates an exemplary support pillow 100 in use. The support pillow 100 is constructed of a cushion base 10 and a padded pillow top 30. The cushion base 10 and the padded pillow top 30 are similar in shape and construction and resemble the shape of a kidney bean or half moon.

Figure 2:
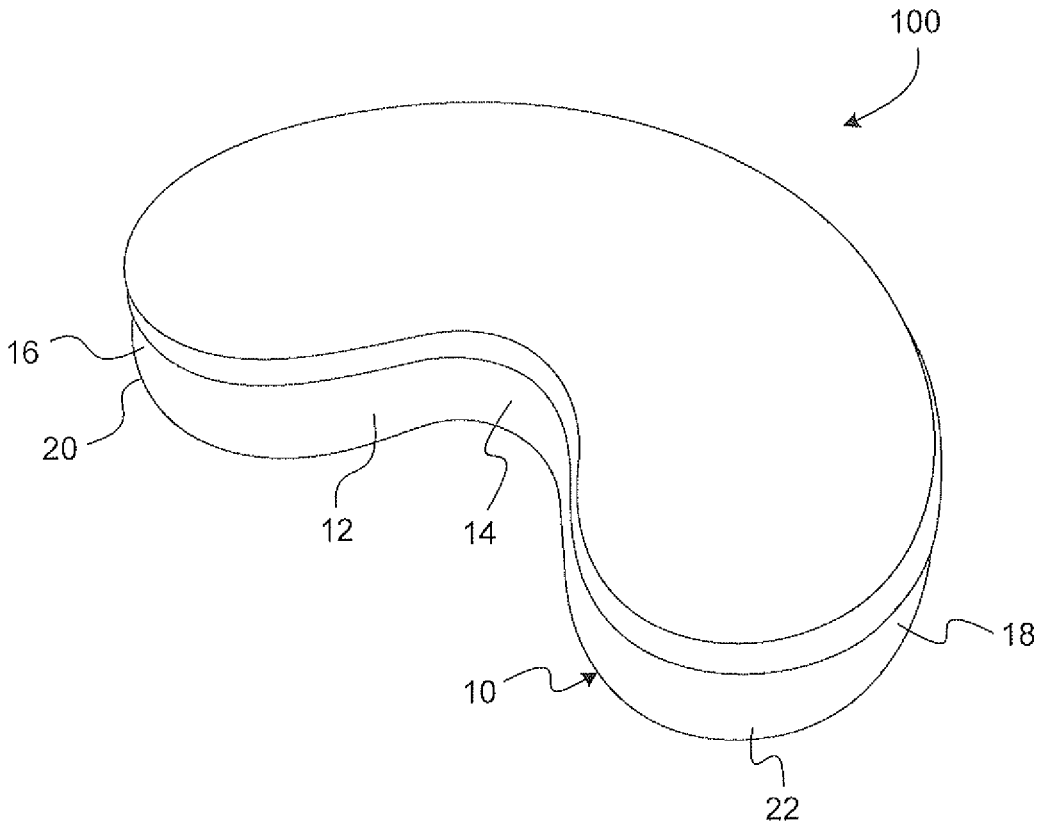
FIG. 2 shows a front perspective view of the nursing pillow.

FIG. 2 shows the cushion base 10 having a cushion body 12. The cushion body 12 includes a midsection 14 and two end sections 16 and 18. The two end sections 16 and 18 terminate in curved ends 20 and 22. The height of midsection 14 may lessen along end sections 16 and 18, or may be substantially consistent throughout the cushion base 10.

Figure 3:
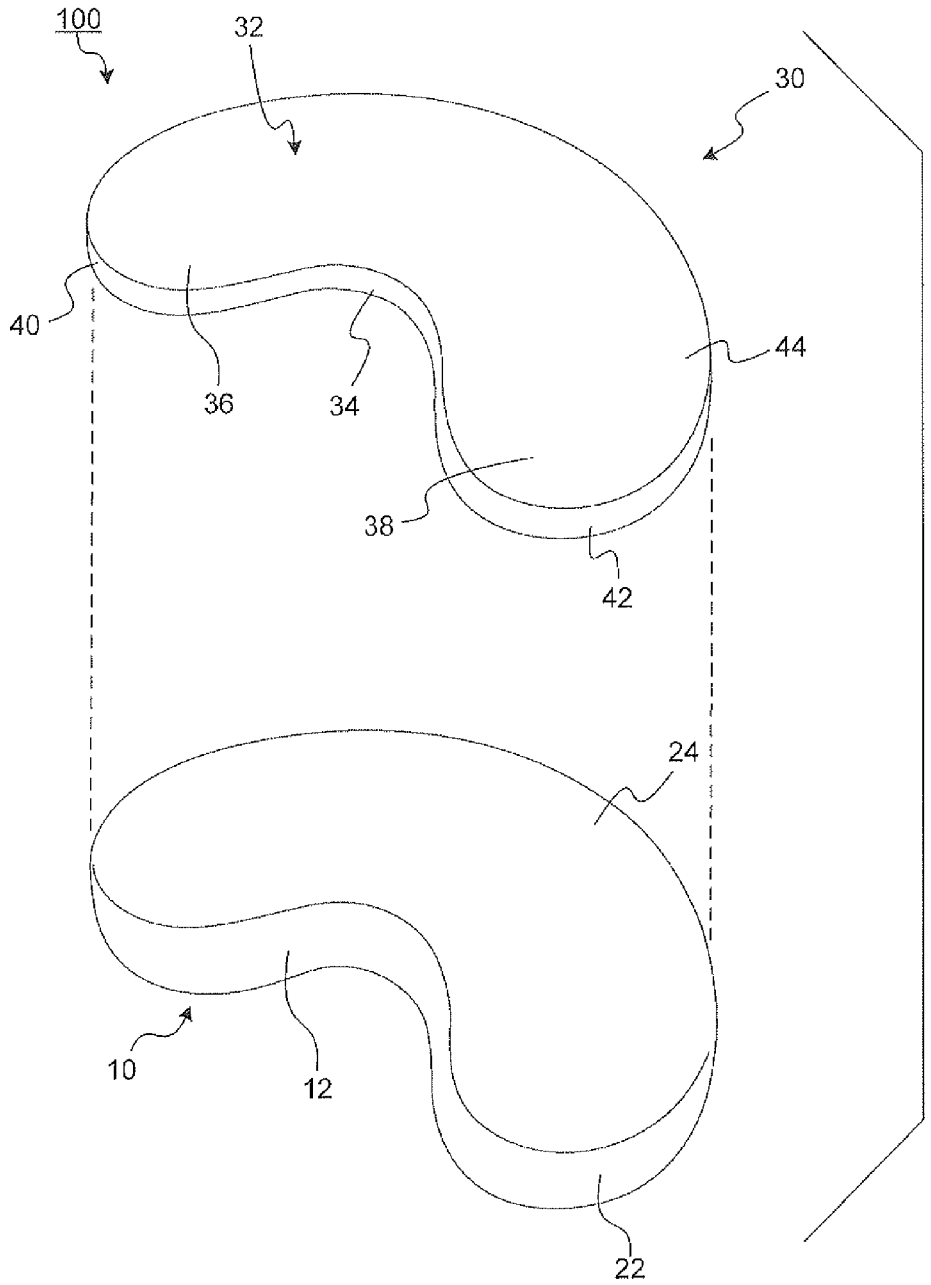
FIG. 3 depicts an exploded perspective view of the nursing pillow having a cushion base and a padded pillow top.

FIG. 3 shows an exploded front perspective view of the padded pillow top 30 separated from the cushion base 10. The padded pillow top 30 having a pillow body 32, which includes a midsection 34 and two end sections 36 and 38. The two end sections 36 and 38 terminate in curved ends 40 and 42.

The cushion body 12 may be constructed of a filler material (not shown) that is surrounded by a cushion cover 24. Similarly, the padded pillow top 30 may be constructed of a filler material (not shown) that is surrounded by a pillow cover 44. The covers 24, 44 may be any type of fabric such as cotton, nylon, LYCRA, denim, polyester or any other suitable material. For example, various natural and/or man-made fabrics may be employed, such as knits and woven fabrics selected from at least one of a light weight, medium weight, and/or heavy weight fabric and/or other suitable material fabric. The covers 24, 44 can also be made from a light, stretchable material, such as elasticized cotton, muslin, fleece, blended materials and/or other suitable material. Other materials may include the use of organic and/or unbleached materials which are suitable for infant care. The cushion cover 24 may be of the same material as the pillow cover 44, or the covers 24, 44 may take any number of combinations of suitable materials.

Alternatively, the covers 24, 44 may be made from sheet material. Many fabrics known in the art may be used depending on the desired characteristics such as elasticity, warmth, weight, breathability, stain resistance, absence of allergens, visual appeal and other factors. The covers 24, 44 may be made of a single or multiple layer material or parts of different materials. Flexible, non-fabric materials may also be used to provide special characteristics. Likewise, the various materials may be made of the same or different material weight.

Furthermore, various examples of filler materials that may be used include, but are not limited to: a resilient, compression resistant, hypoallergenic material, such as polyester fibers, foam, cotton, and/or any other suitable soft compressible material. The filler material may be stuffed inside covers 24, 44 to provide sufficient firmness so that cushion base 10 the padded pillow top 30 generally do not sag or droop when held at either midsection 14, 34. The filler material used in the cushion base 10 may also be different from the filler material used in the padded pillow top 30 to vary the firmness of each. This also provides sufficient firmness so that an item, object, baby or the like is supported without significant deflection or indentation of cushion body 12 or padded pillow top 30.

Figure 4:
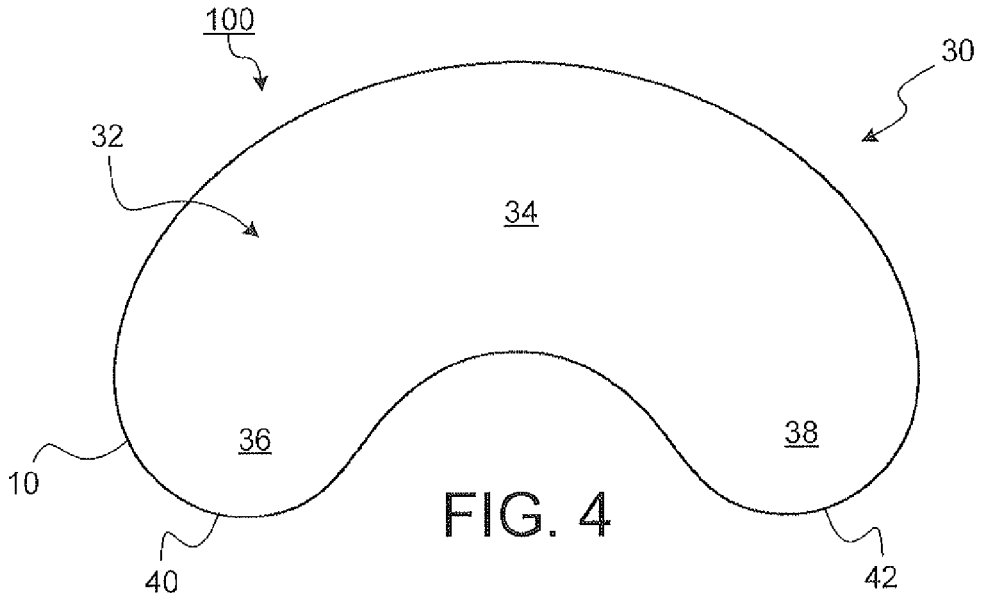
FIG. 4 shows a top view of the nursing pillow.

FIG. 4 shows a top view of the support pillow 100. In one aspect, the support pillow 100 comprises a cushion body 10 that is gently curved. The amount of curvature is selected so that the end sections 36, 38 of the support pillow 100 are spaced enough apart to permit the support pillow 100 to be placed around individuals having a variety of different size torso's. The amount of curvature may be defined in terms of an "average" radius of curvature. This dimension represents the radius that is generated if an arc is drawn between a center point of the cushion body 10 and the two end sections 36, 38. Because the support pillow 100 may not be fashioned according to a true geometric arc, the term "average" is used to indicate it is merely an approximation. Hence, the support pillow 100 may be curved according to a true arc or other suitable type of geometric curvature. Further, the support pillow 100 may have a wide variety of shapes and other design features including rounded or curved edges or ends, tapered sides or ends, patterned edges, sloping or curved sections and the like.

Figure 5:
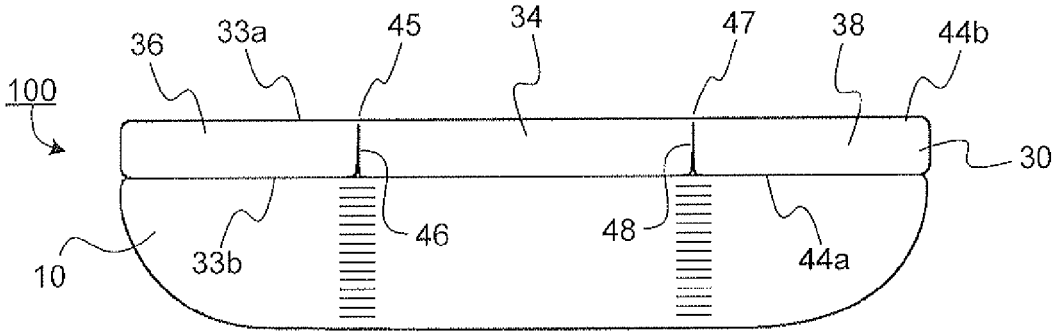
FIG. 5 shows a front view of the nursing pillow.

FIG. 5 illustrates a front view of the support pillow 100. The padded pillow top 30 may include a seam 45 which forms a gap 46 between the midsection 34 and the end section 36. Similarly, the padded pillow top 30 may include a seam 47 which forms a gap 48 between the midsection 34 and the end section 38.

The padded pillow top 30 may be constructed of three different portions, i.e., the midsection 34, and the two end sections 36, 38. The three portions may be completely separated or substantially separated but connected at hinge points aligned at the seams 45, 47. The cover 44 may be constructed to house the three portions separately albeit capable of providing a hinge support at the seams 45, 47 as will be shown in detail later. The seams 45, 47 may connect the midsection 34 to the end sections 36, 38 by connecting a bottom portion 44*a* of the cover 44 to a top portion 44*b*. However, other techniques could be used as well. For example, a zipper, snaps, and/or any other suitable method may also be used instead of the seams 45, 47.

The hinge points aligned at the seams 45, 47 may lie flush with a top surface 33*a* of the padded pillow top 30, as shown in FIG. 5, or a bottom surface 33*b* of the padded pillow top 30 as will later be discussed. The gaps 46, 48 may therefore separate the midsection 34 and the end section 36, 38 from the opposing surface to the seam 45, 47. Conversely, the seams 45, 47 may be formed in a range from the top surface 33*a* to the bottom surface 33*b*. For example, the seam 45, 47 may be located at a midpoint between the top and bottom surfaces 33*a*, 33*b* and therefore the gaps 46, 48 would be disposed on either side of the seams 45, 47.

Figure 6:
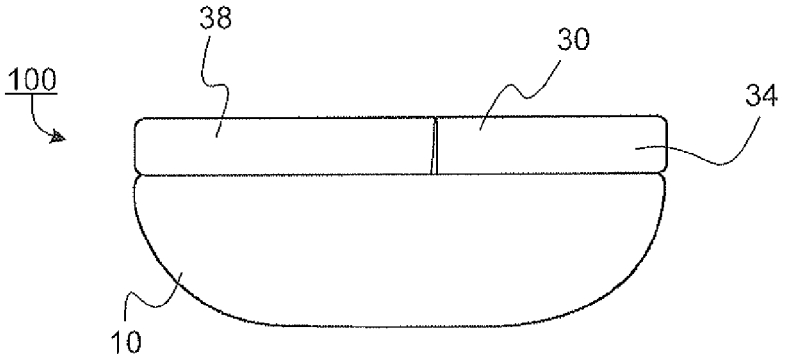
FIG. 6 shows a side view of the nursing pillow.
Figure 7:
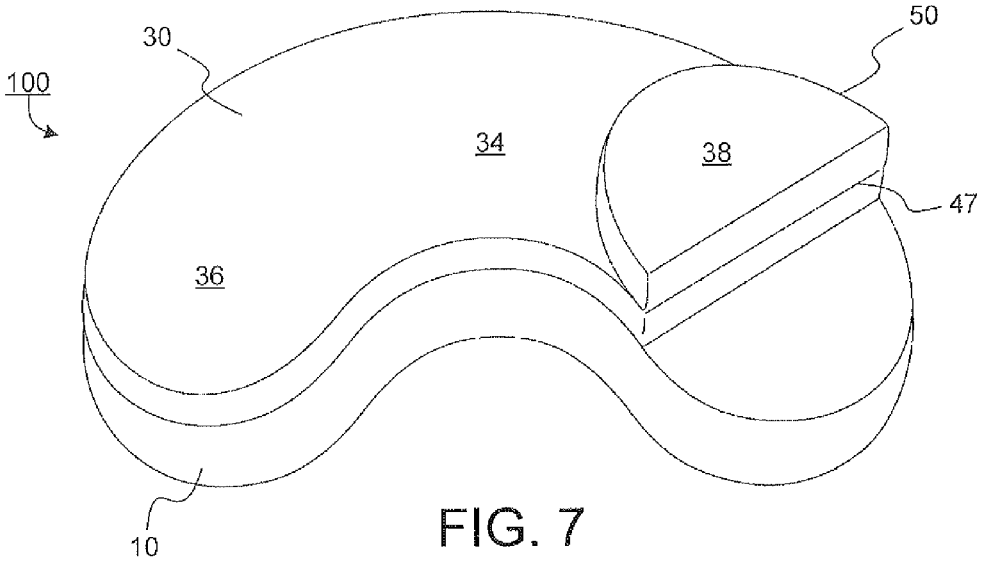
FIG. 7 illustrates the nursing pillow having a first end section folded up.
Figure 8:
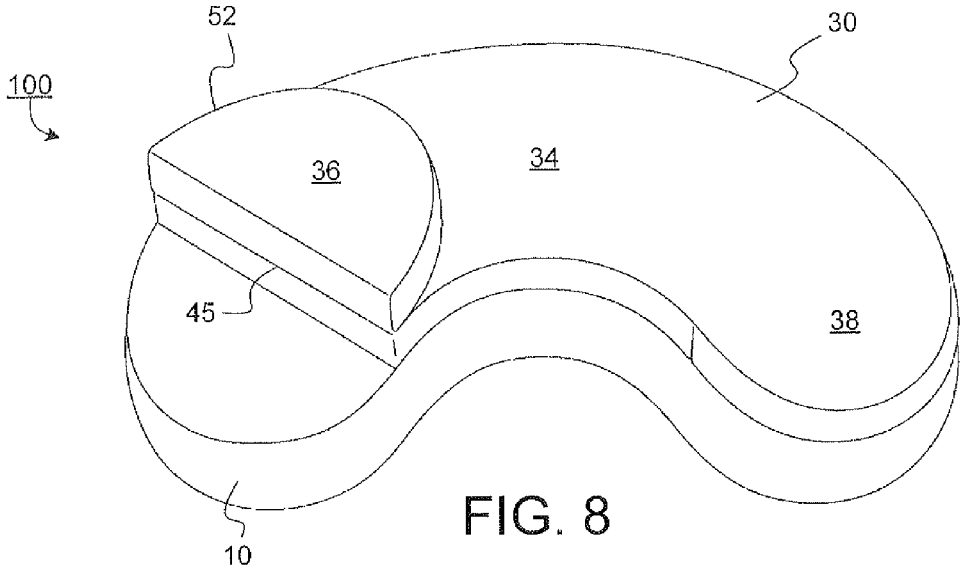
FIG. 8 illustrates the nursing pillow having a second end section folded up.
Figure 9:
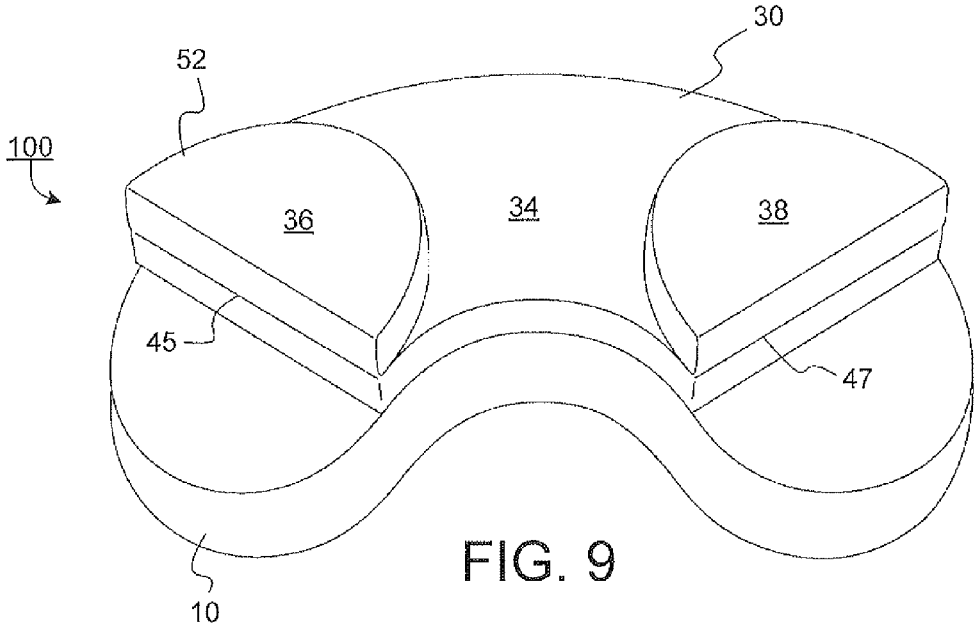
FIG. 9 illustrates the nursing pillow having the first and second end sections folded up.

FIGS. 6-9 illustrate various configurations of the support pillow 100. FIG. 6 shows a side view of the support pillow 100, wherein the end section 38 of the padded pillow top 30 is resting against the cushion body 10. As shown in FIGS. 7-9, the end sections 36, 38 can fold back upward, towards the midsection 34 to effectively create at least one three layer portion 50, 52 of the support pillow 100 consisting of the cushion base 10, the midsection 34 and one of the end sections 36, 38 respectively. The three layer portion 50, 52 may be formed from either end section 36, 38, respectively, shown in FIGS. 7-8, or both as shown in FIG. 9.

The advantage of providing the three layer portions 50, 52 is to enable the infant feeding on a mother's teat to be propped up to a comfortable head height position so that the mother does not have to prop the infant's head up with their arm or hand during breast feeding. Holding the infant's head up can become tiresome to the mother. Providing the double layered pillow effect allows the nursing mother freedom of her hand to perform other tasks such as adjusting her breast or caressing the infant during the nursing process, as shown in FIG. 1.

The various configurations and flexibility provided by the support pillow 100 allow it to be used for a variety of different uses, such as with children, teenagers and adults of various sizes. For example, when sitting down, the support pillow 100 would generally conform to the user's stomach and wrap around her sides. End sections 36 and 38 taper to permit them to fit between the arms of a chair and the user's side. By adjusting which configuration the support pillow 100 is in, the user may adjust a height of the top surface of the support pillow 100 relative to the user. For example, if the support pillow 100 is being used to nurse an infant, the location of the top surface may be varied such that it is positioned at an optimal height. In addition, a user's arms or elbows may also rest on the padded pillow top 30 to hold an item at about eye level. By also having ends 20 and 22 wrap around the user's side, this contour facilitates supporting of the user's arms or elbows. Since the user can adjust both end sections 36, 38, they can easily switch which side of the user's body the baby is facing and adjust where the user's arms or elbows are resting.

Figure 10:
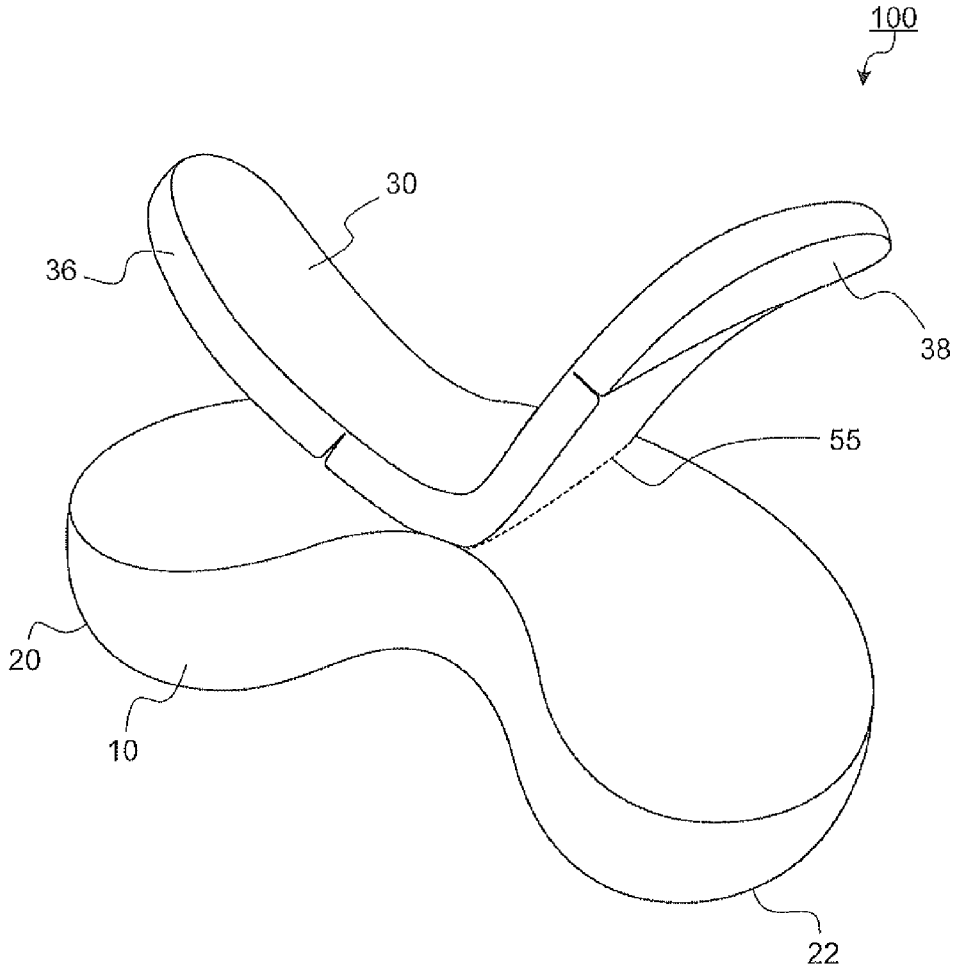
FIG. 10 depicts the nursing pillow with the padded pillow top folded upwardly to show a connection with the cushion base.

FIG. 10 depicts the padded pillow top 30 connected to the cushion base 10 at a center seam 55. The padded pillow top 30 may be folded in half at the center seam 55 such that the end section 38 rests against the end section 36 to form an additional configuration. The center seam 55 may connect the padded pillow top 30 to the cushion base 10 through stitching, however a zipper, snaps, or any other suitable position or method may also be used.

Although not shown, it will be appreciated that other features may be added to the support pillow 100. For example, various toys or other items may be attached to or surrounded above the support pillow 100 as described in any of the references incorporated herein. Also a strap may extend between ends 20 and 22 to help hold the support pillow 100 about a user. As other examples, one or more pockets or other attachment members (such as straps) may be attached to the support pillow 100 to hold a variety of items, such as described in the references incorporated herein. As some specific examples, the pockets may be used to hold bottles, toys, burping cloths, and the like. Support pillow 100 may also have one or more handles to help transport the pillow. Such handles may be similar to those described in references incorporated herein. Still further, the support pillow 100 may have a head member (such as an animal head) attached anywhere along the pillow, such as at one end.

Figure 11:
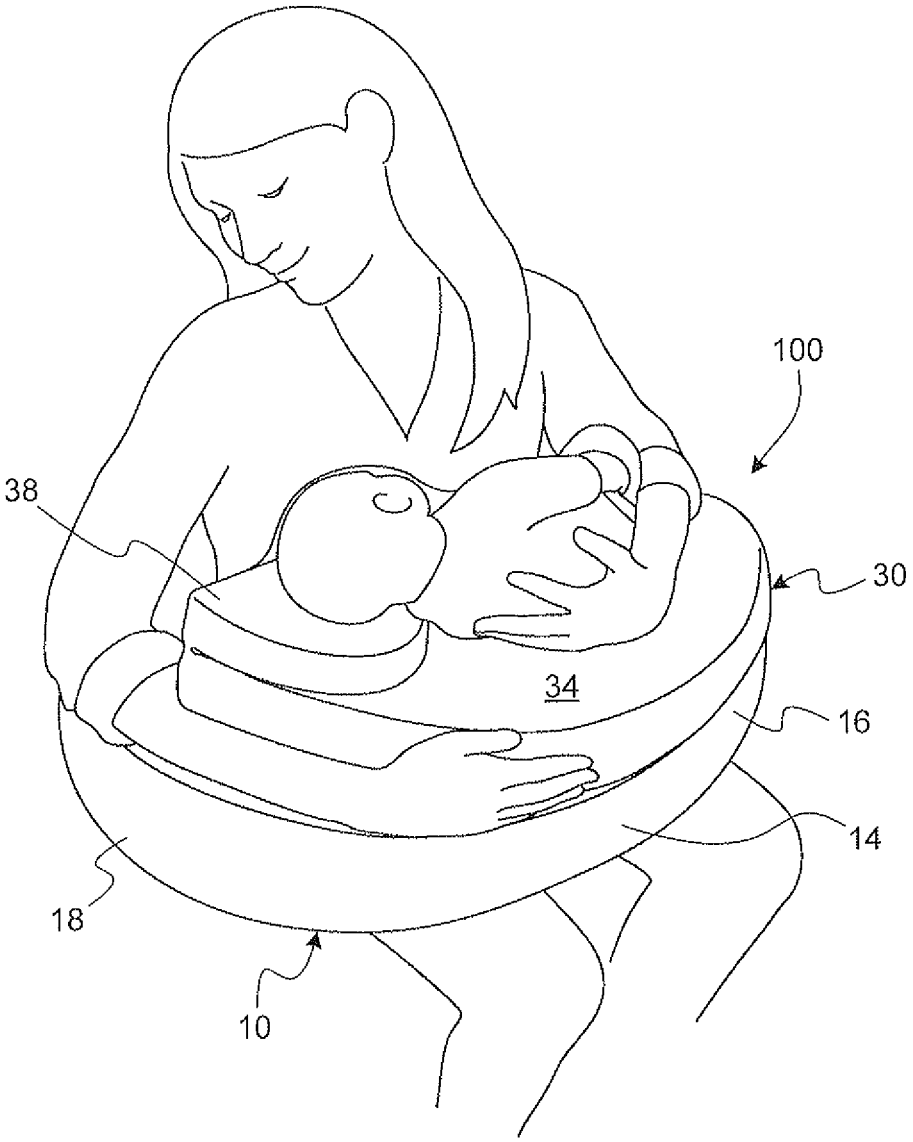
FIG. 11 illustrates the nursing pillow when held in a user's lap to support an infant.

FIG. 11 shows the support pillow 100 resting on the lap of a user. Here a baby is shown supported on top of the support pillow 100 while being fed or nursed. In this position, midsection 14 rests on the user's lap while end sections 16 and 18 wrap around the user's sides. The user has her arm placed between the midsection 34 of the padded pillow top 30 and the end section 18 of the cushion base 10 to provide further support to prop up the baby's head. The end section 38 is folded back against the midsection 34 to provide the baby's head support while the baby rests on top of the padded pillow portion. In this way, if the baby's head needed to be lifted higher, this may be accomplished by changing the configuration of the support pillow 100.

Further, it will be appreciated that a variety of other uses for support pillow 100 exist. These may include, for example, as a back support, as a traditional pillow for the head, to prop up a baby or child, as a seat cushion or the like. As another example, the pillow may be used to support the legs or hips. For example, when a person is lying on his or her back, the pillow may be placed between the user's legs or knees and the ground. This permit's the person's legs to be propped up. As a further example, the pillow may be placed between the person's legs or knees while the person is lying on his or her side. As still another example, the pillow may be used as a back or front support when the person is lying on his or her side. For instance, for a pregnant woman, the pillow could be placed between the mother's stomach and the ground to help support the stomach. Other examples of how such a pillow may be used are described in any of the references incorporated herein.

Figure 12:
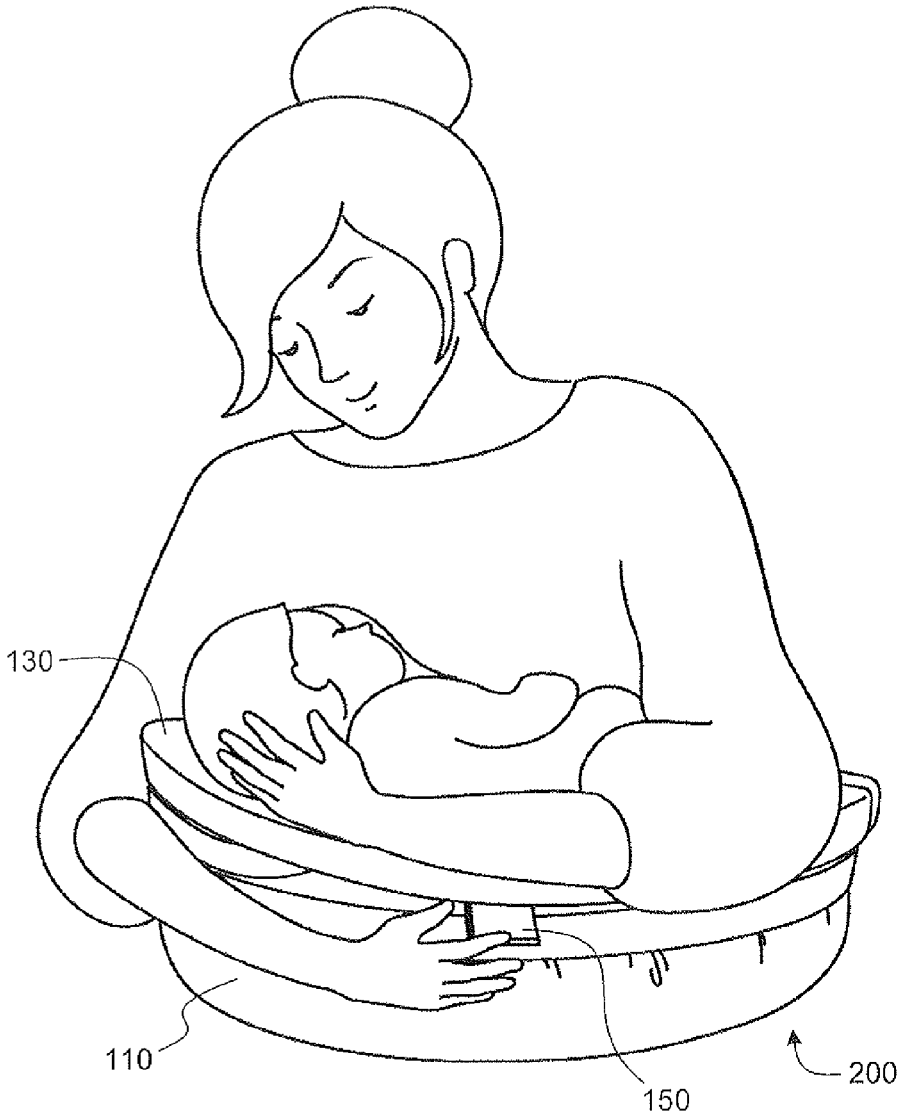
FIG. 12 shows another exemplary nursing pillow according to the subject disclosure.

FIGS. 12-21 depict another exemplary support pillow 200 according to the subject disclosure. FIG. 12 illustrates the support pillow 200 constructed of a cushion base 110 and a padded pillow top 130. The support pillow also has a strap 150 which connects the cushion base 110 to the padded pillow top 130.

Figure 13:
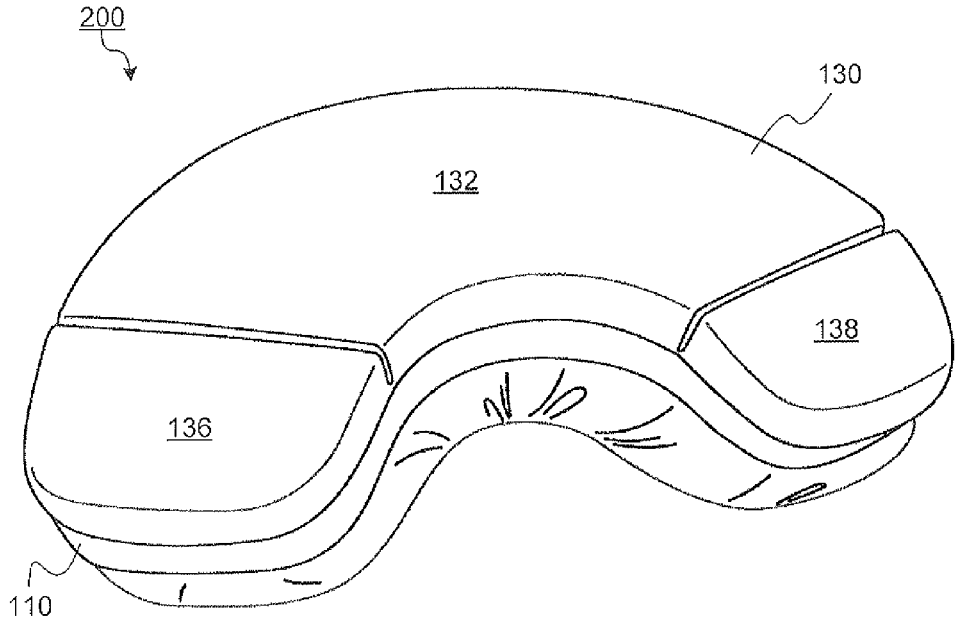
FIG. 13 depicts a front perspective view of the nursing pillow in FIG. 12.
Figure 14:
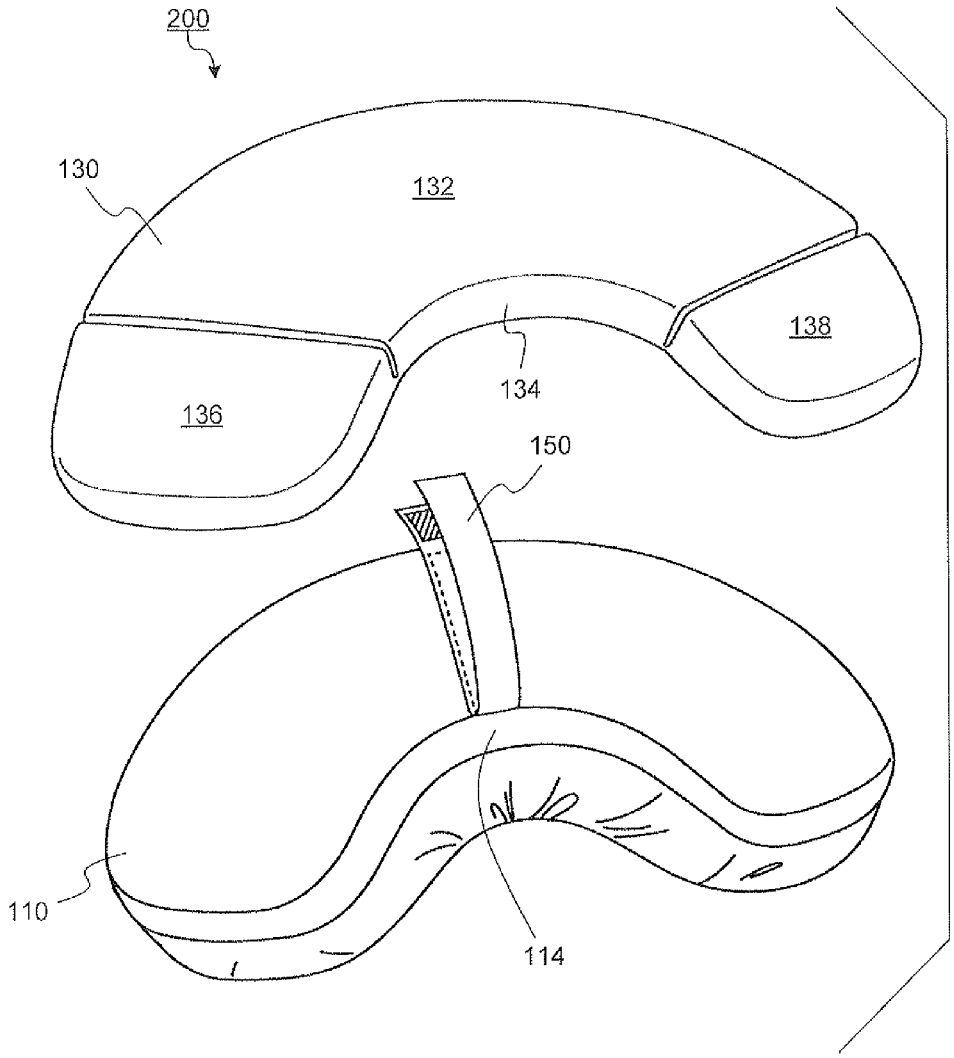
FIG. 14 illustrates an exploded perspective view of the nursing pillow having a cushion base, a padded pillow top and a strap.

FIGS. 13-14 show the padded pillow top 130 having a pillow body 132 and two foldable ends 136, 138. FIG. 14 further depicts the strap 150 connected to a midsection 114 of the cushion base 110. The strap 150 may be connected to a top surface of the cushion base 110, or similarly may be connected to a bottom surface of the padded pillow top 130.

Figure 15:
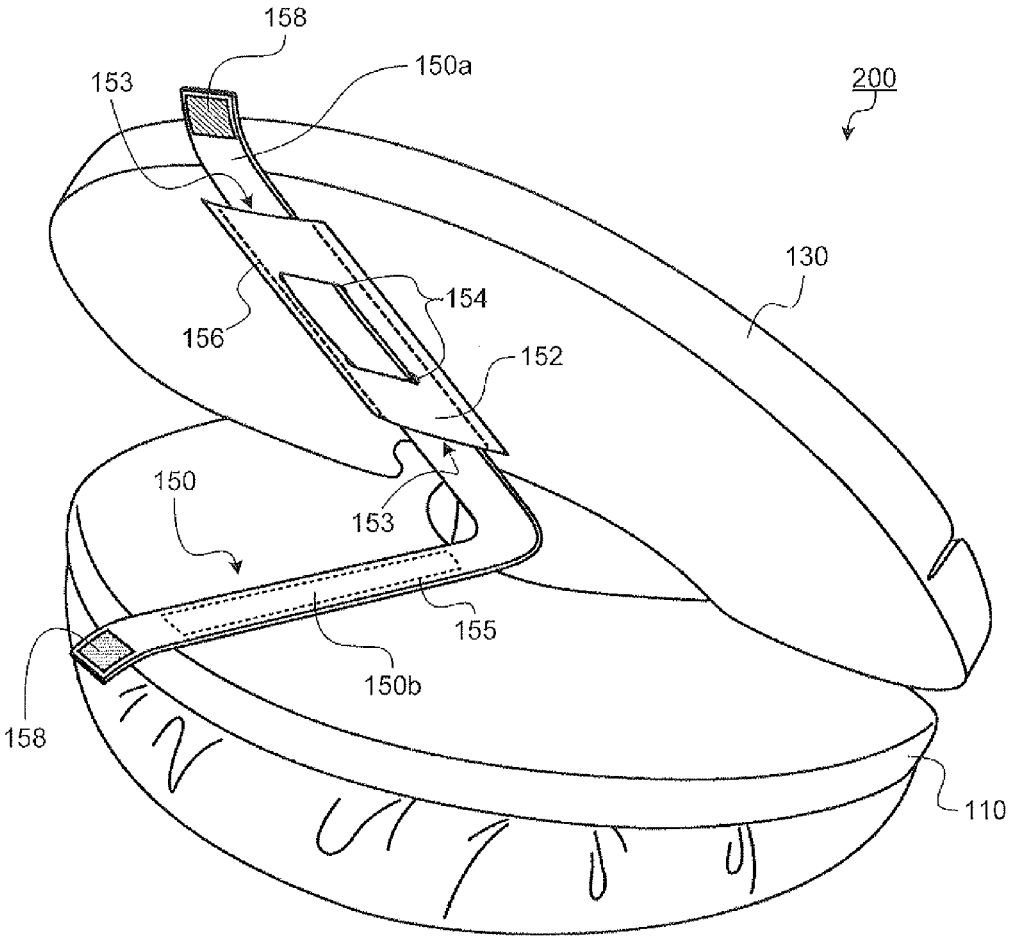
FIG. 15 shows the nursing pillow in with the padded pillow top lifted upwardly to show a connection with the cushion base.

FIG. 15 illustrates in greater detail the strap 150 connecting the cushion base 110 to the padded pillow top 130. The strap 150 comprises a first half 150*a*, a second half 150*b*, stitching 155 and a fixing or fastening mechanism 158. The second half 150*b* of the strap 150 may be connected to the cushion base 110 through the stitching 155 which runs parallel to the strap 150 and terminates at an inner and outer edge of the cushion body 110. The strap 150 may also connect to the cushion base 110 or padded pillow top 130 through other various stitching patterns, VELCRO®, snaps, zippers, or other suitable methods of fixing the strap 150 to the support pillow 200.

The first half 150*a* of the strap 150 extends from the second half 150*b*, though a one piece sleeve 152 and terminates in the fastening mechanism 158. The sleeve 152 is attached to the padded pillow top 130 by stitching 156 which runs along lateral edges of the sleeve 152. This creates a pocket 153 which holds the strap 150 along its length. The sleeve 152 may also comprise slits 154 which help facilitate pulling the strap 150 through the pocket 153. The user can pull the strap 150 into the pocket 153, then out of the pocket 153 through the slit 154, then back into the pocket 153 though another slit 154 and finally out of the pocket 153.

The fastening mechanism 158 is located on both ends of the strap 150 and connect the first half 150*a* to the second half 150*b* to form a closed loop. The fastening mechanism 158 can be one or more hook-and-loop fasteners (e.g. VELCRO®), metal snaps, plastic snaps, buttons and button holes, zippers, sewn magnets arranged for magnetic attraction and closure, and/or any other suitable fastening mechanism in accordance with this subject disclosure. Furthermore, the fastening mechanism 158 may be located on the outer side of the support pillow 200 (as shown in FIG. 15). This would allow the user to easily and comfortably release the fastening mechanism 158 while the having the support pillow 200 on their lap. However, it is to be understood that the fastening mechanism 158 may also be located on an inner side of the support pillow 200 as well.

Furthermore, the padded pillow top 130 may be flipped over such that the sleeve 152 is facing upwards, away from the support pillow 200. In this configuration, the strap 150 would pass over the padded pillow 130 first before entering the pocket 153. This would allow the foldable ends 136, 138 to fold upwards, away from the cushion base 110, as opposed to towards the cushion base 110. Similarly, the sleeve 152 may be placed on both sides of the padded pillow 130. This increases the number of possible configurations of the support pillow 200, as will be discussed in greater detail below.

Figure 16:
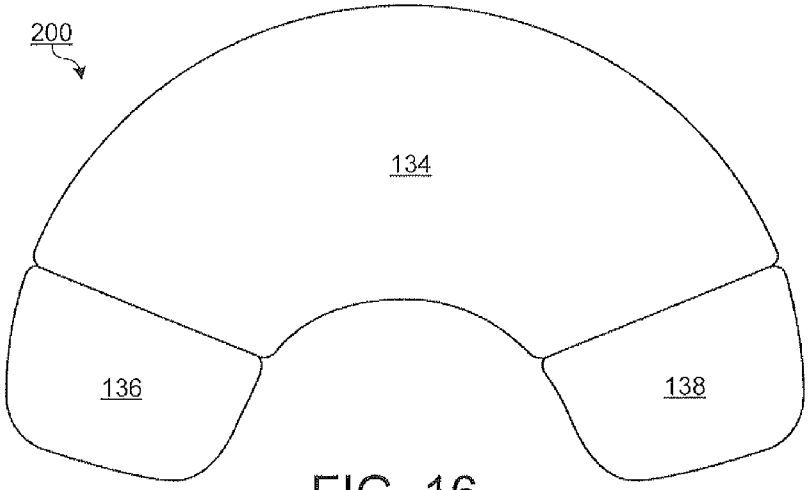
FIG. 16 depicts a top view of the nursing pillow.
Figure 17:
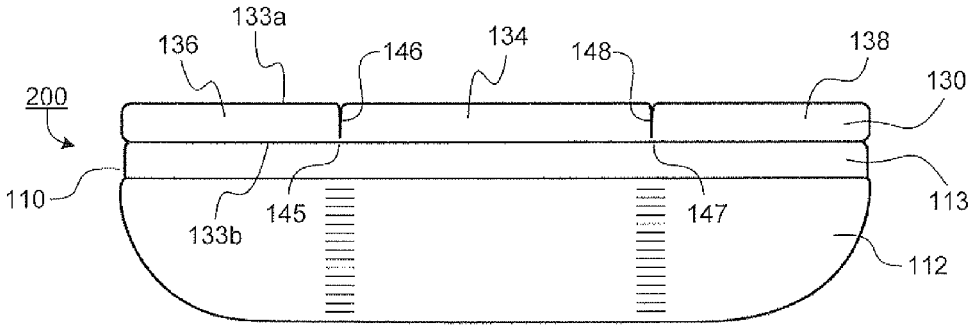
FIG. 17 illustrates a front view of the nursing pillow.
Figure 18:
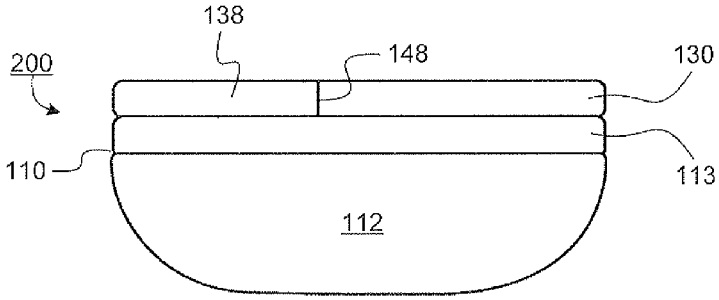
FIG. 18 shows a side view of the nursing pillow.

FIGS. 16-18 further illustrate various pan views of the support pillow 200. FIG. 17 shows the cushion base having a padded top portion 113 and a cushion body 112. In addition, the padded pillow top 30 may include seams 145, 147 which form gaps 146, 148 between the midsection 134 and the two foldable ends 136, 138. In such a manner, the padded pillow top 130 may be constructed into three portions, i.e., the midsection 134 and the two foldable ends 136, 138. Each foldable end 136, 138 may be capable of rotating about a hinge support created by the seams 145, 147, as will be shown in detail later. The seams 145, 147 may be located on the bottom of the padded pillow top 130 as shown in FIG. 17, but also may be reversed so they are located on the top of the padded pillow top 130 to increase the number of different configurations the support pillow 200 can take.

The hinge supports created by the seams 145, 147 may lie flush with a bottom surface 133*b* of the padded pillow top 130. The gaps 146, 148 may therefore separate the midsection 134 and the end section 136, 138 from the opposing surface to the seam 145, 147.

Figure 19:
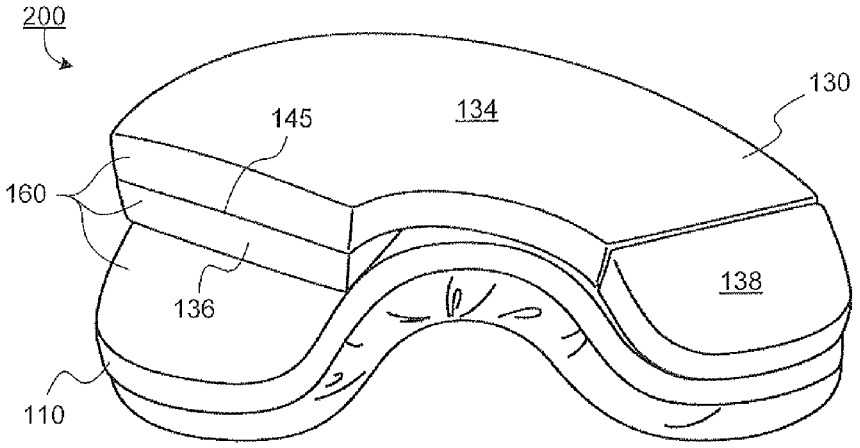
FIG. 19 depicts the nursing pillow having a first foldable end section folded down.
Figure 20:
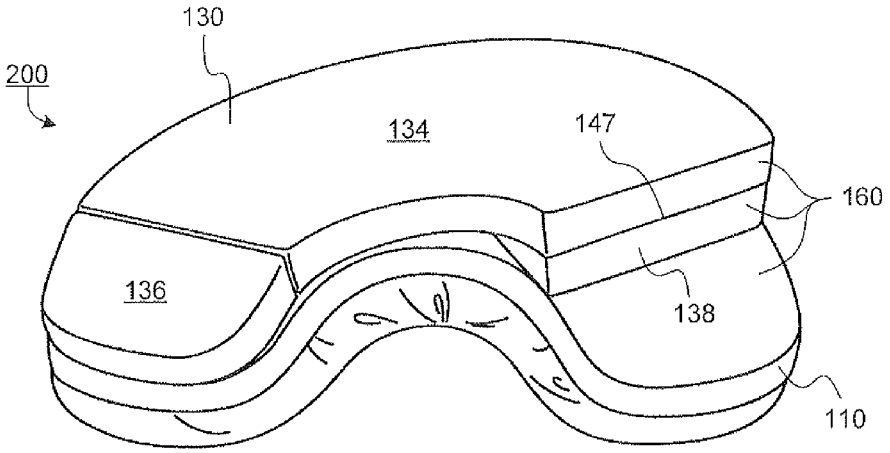
FIG. 20 illustrates the nursing pillow having a second foldable end section folded down.
Figure 21:
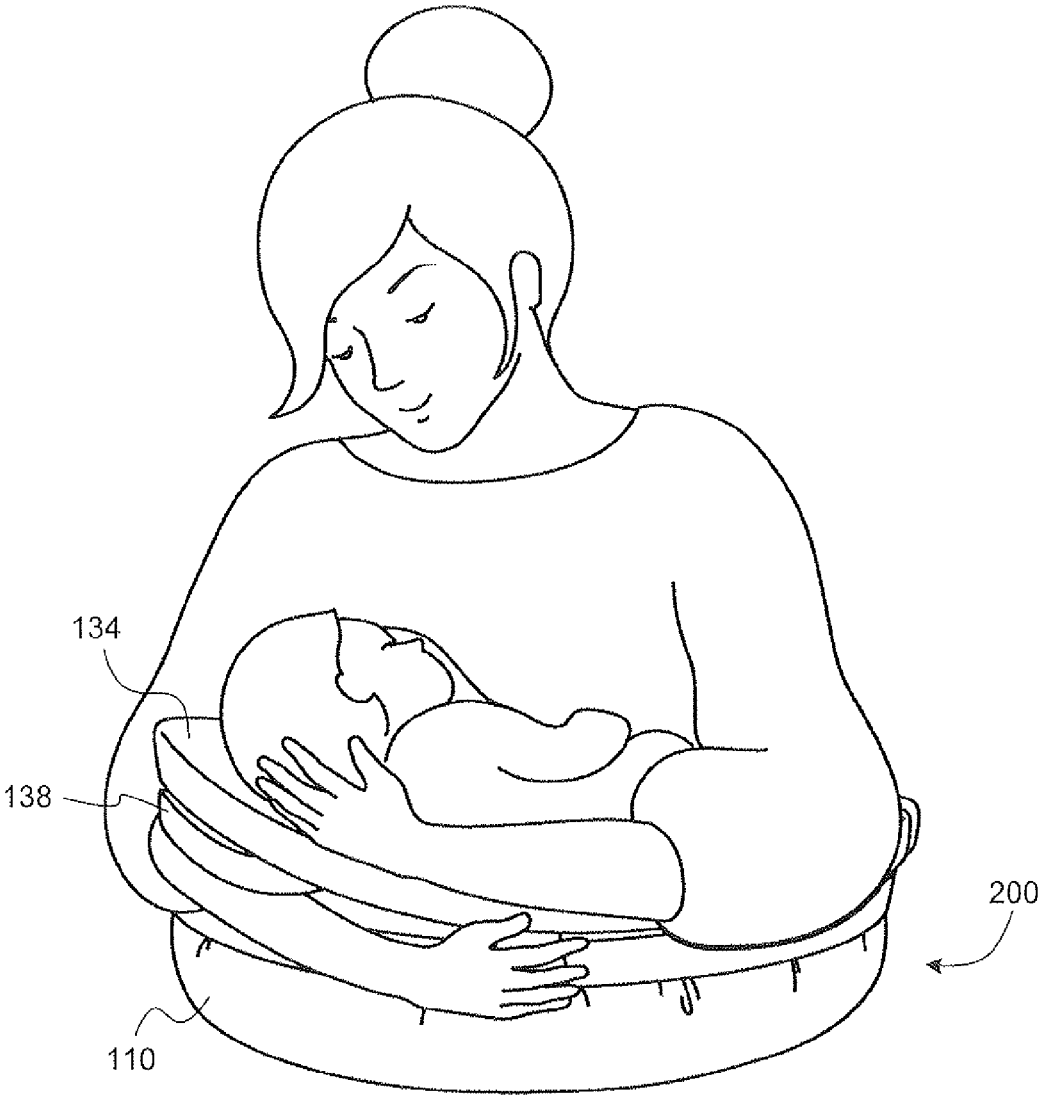
FIG. 21 shows the nursing pillow when held in a user's lap to support an infant.

FIGS. 19-21 depict various configurations of the support pillow 200 wherein the foldable ends 136, 138 are adjusted to rest between the padded pillow top 130 and the cushion base 110. Tucking the foldable ends 136, 138 inward, towards the cushion base 110 effectively creates at least one three layer portion 160 of the support pillow 200 consisting of the cushion base 110, the midsection 134 and one of the foldable ends 136, 138. Furthermore, if the padded pillow top 130 is reversed such that the sleeve 156 is facing away from the cushion base 110, then the foldable ends 136, 138 would fold away from the cushion base to form the three layer portion 160.

This gives the user or care taker all of the same advantages and uses previously discussed. As shown in FIG. 21, tucking the foldable end 138 under the midsection 134 allows the care taker to elevate the baby's head. The care taker may also rest her arm underneath the foldable end 138 to lift the baby's head further if needed.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed:

1. A support pillow, comprising:

a curved cushion body having a top surface, a bottom surface, a midsection and a pair of curved arms that each have an end;

a padded pillow top that is fastened to a midpoint on the top surface of the cushion body, the pillow top having a predetermined height to permit the height of at least a portion of the pillow top body to be adjusted relative to a support surface when the pillow top is positioned on the top surface of the cushion body, wherein the pillow top has a midportion, a pair of opposing foldable ends, and a pair of hinges, each hinge being proximate to a corresponding one of the foldable ends wherein one hinge is disposed between the midportion and one of the ends of the pillow top and another hinge is disposed between the midportion and the other end of the pillow top;

each of the pair of opposing foldable ends having a first height at the corresponding hinge and a second height at a relatively outboard edge generally parallel to the corresponding hinge, the first height is substantially equal to the second height;

wherein each of the hinges is formed by a separate corresponding seam located on and extending transversely across a bottom surface of the pillow top, wherein each foldable end is configured to individually fold about the corresponding seam and under the midportion such that at least part of the midportion is raised and angled relative to the cushion body.

2. The support pillow as recited in claim 1, wherein the pillow top comprises one piece of foam that is generally similar in shape to the cushion body.

3. The support pillow as recited in claim 2, wherein the pillow top and the cushion body have a kidney bean shape.

4. The support pillow as recited in claim 1, wherein the pillow top is secured to the cushion body with a strap.

5. The support pillow as recited in claim 4, wherein the strap passes through a sleeve attached to one of either the pillow top or the cushion body.

6. The support pillow as recited in claim 5, wherein the sleeve comprises slits adapted to receive the strap.

7. The support pillow as recited in claim 1, wherein the pillow top is fastened to the cushion body by a strap.

8. The support pillow as recited in claim 7, wherein the pillow top comprises a sleeve secured to the midsection of the pillow top, wherein the sleeve is adapted to receive the strap.

9. The support pillow as recited in claim 8, wherein an attachment secures the strap to the cushion body from an inner end of the cushion body with a smaller average arc to an outer end of the cushion body with a larger average arc, the attachment running parallel to the strap.

10. The support pillow as recited in claim 8, wherein the sleeve comprises a pocket formed by an attachment running along lateral edges of the sleeve, the pocket adapted to receive and secure the strap along a length of the pocket.

11. The support pillow as recited in claim 10, wherein the sleeve comprises at least one slit adapted to receive the strap.

12. The support pillow as recited in claim 7, wherein the strap further comprises a fastening mechanism, the fastening mechanism adapted to connect a first end of the strap to a second end of the strap to form a closed loop.

* * * * *